US006348146B1

(12) United States Patent
Gibson et al.

(10) Patent No.: US 6,348,146 B1
(45) Date of Patent: Feb. 19, 2002

(54) SYSTEM AND METHOD TO EFFECTUATE AND CONTROL COKER CHARGE HEATER PROCESS FLUID TEMPERATURE

(75) Inventors: William C. Gibson, Tulsa; Robert L. Gibson, Broken Arrow, both of OK (US)

(73) Assignee: Petro-Chem Development Co., Inc., New York, NY (US)

( * ) Notice: Subject to any disclaimer, the term of this patent is extended or adjusted under 35 U.S.C. 154(b) by 0 days.

(21) Appl. No.: 09/621,047

(22) Filed: Jul. 21, 2000

Related U.S. Application Data

(62) Division of application No. 09/387,056, filed on Aug. 31, 1999, now Pat. No. 6,245,218.

(51) Int. Cl.[7] ..... C10G 9/20
(52) U.S. Cl. ..... 208/131; 208/50; 208/DIG. 1
(58) Field of Search ..... 208/131, 50, DIG. 1

(56) References Cited

U.S. PATENT DOCUMENTS 4,661,241 A * 4/1987 Dabkowski et al. ..... 208/131
4,670,133 A * 6/1987 Heaney et al. ..... 208/131
4,983,272 A * 1/1991 Stavropoulos ..... 208/50
6,048,448 A * 4/2000 Nirell ..... 208/67

* cited by examiner

*Primary Examiner*—Bekir L. Yildirim
(74) *Attorney, Agent, or Firm*—Head, Johnson & Kachigian

(57) ABSTRACT

A system and method to improve the efficiency of delayed coker charge heating by effecting and controlling the temperature of a coker process fluid, prior to its introduction to a coker charge heater. In its preferred embodiment, the instant invention strategically positions and controls a pre-heater to automatically stabilize and minimize delayed coker charge heater firing rates. Said pre-heater's set point is derived by a feed forward control system that allows for the detection of process fluid temperature within a combination tower bottom, and communicates that temperature value to a pre-heater. Based upon the temperature value communicated to the pre-heater, the pre-heater intensifies, maintains, or decreases its firing to effect an operationally consistent combination tower bottoms temperature. By maintaining nearly constant combination tower bottoms temperature, a delayed coker charge heater derives enhanced operational efficiency and increases its life expectancy. Such benefits result from a nearly constant coker charge beater process fluid inlet temperature and optimized coker firing rates.

7 Claims, 6 Drawing Sheets

SYSTEM AND METHOD TO EFFECTUATE AND CONTROL COKER CHARGE HEATER PROCESS FLUID TEMPERATURE

REFERENCE TO PENDING APPLICATIONS

This is a divisional application of application Ser. No. 09/387,056 filed Aug. 31, 1999, now U.S. Pat. No. 6,245,218 .

This application is not related to any pending applications.

REFERENCE TO MICROFICHE APPENDIX

This application is not referenced in any microfiche appendix.

TECHNICAL FIELD OF THE INVENTION

In general, the present invention is directed to crude oil refining. In particular, the present invention is directed to a system and method to advance the efficiency of severe thermal cracking, or coking, by effecting and stabilizing the temperature of coker feedstock, or process fluid, preceding its introduction to a coker charge heater.

BACKGROUND OF THE INVENTION

The present invention can be best understood and appreciated by undertaking a brief review of the crude oil distillation process, and most particularly, the critical role coker charge heaters play within that process.

In its unrefined state, crude oil is of little use. In essence, crude oil (a.k.a. hydrocarbon) is a complex chemical compound consisting of numerous elements and impurities. Such impurities can include, but are not limited to sulfur, oxygen, nitrogen and various metals that must be removed during the refining process.

Refining is the separation and reformation of a complex chemical compound into desired hydrocarbon products. Such product separation is possible as each of the hundreds of hydrocarbons comprising crude oil possess an individual boiling point. During refining, or distillation, crude oil feedstock temperature is raised to a point where boiling begins (a.k.a. "initial boiling point, or "IBP") and continues as the temperature is increased. As the boiling temperature increases, the butane and lighter fraction of crude oil are first distilled. Such distillation begins at IBP and terminates slightly below 100° F. The fractions boiling through this range are represented and referred to as the "butanes and lighter cut." The next fraction, or cut, begins slightly under 100° F. and terminates at approximately 220° F. This fraction is represented and referred to as straight run gasoline. Then, beginning at 220° F. and continuing to about 320° F. the Naphtha cut occurs, and is followed by the kerosene and gas/oil cuts, occurring between 320° F. and 400° F., and 450° F. to 800° F., respectfully. A term-of-art "residue cut" includes everything boiling above 800° F.

The residue cut possesses comparatively large volumes of heavy materials and two fundamental processes are employed to convert appreciable amounts of such residuals to lighter materials—thermal cracking and delayed coking. While thermal-cracking may be properly considered "the use of heat to split heavy hydrocarbon into its lighter constituent components," delayed coking should be considered "severe thermal cracking" and occurs within a coke drum after a coker feedstock has been heated in an apparatus referred to as a coking heater, or "delayed coker charge heater." An improved delayed coker charge heater and process serve as the focus of the instant invention.

In the present art, fresh feed is preheated by preheat exchangers exclusively, prior to introducing such feed to combination tower for processing. Fresh feed of a cold variety is first introduced to the refining process from tankage, while hot feed is introduced to the refining process from a vacuum distillation unit, or units. As preheat exchangers foul from use, their operating efficiency diminishes over time. Less efficient preheat exchangers, in turn, occasion temperature variances in fresh feed prior to its introduction to a combination tower. Coke drum overhead temperatures and flow rates also vary, as do heavy gas only (HGO) quench rates, both contributing to the instability of residuals temperature at the bottom of a combination tower. Especially large temperature savings occur when switching from a hot coke drum to a cold coke drum. Consequently, a combination tower's bottom temperature varies greatly based upon input from the afore stated sources.

The utilization of coker pre-heaters are well known in the art. As intended, the purpose of a coker pre-heater was to preheat process fluid, or coker feedstock, when the unit was designed without an effluent exchanger train or with a minimally configured feed/effluent exchanger train. In such instances, temperature control and firing rates are based on pre-heater outlet temperature. The present art clearly lacks innovative consideration to maintain, stabilize, and control combination tower "bottoms" temperature. In providing for such maintenance, stabilization and control, the present invention introduces a novel means by which "temperature stabilized" combination tower bottoms can be introduced to a coker charge heaters, and thus, maintain and stabilize the firing rates of such heaters.

Hence, given the deficiencies of the present art and improvements afforded by the instant invention, what is needed is an improved system and method to effect and control temperature of coker process fluid, in advance of introducing such fluid to a coker charge heater.

BRIEF SUMMARY OF THE INVENTION

The present invention provides for an improved method and article of manufacture for greatly improving upon coker charge heater performance and longevity. By maintaining and controlling the combination tower bottom's temperature, the absorbed duty rate and firing rate of a coker charge heater can be held nearly constant. Maintaining a nearly constant coker firing rate prevents the tubes in the charge heater from overheating during inlet temperature swings associated with the prior art. Of equal or greater importance is that preventing tubes from overheating also reduces the rate of internal coker tube fouling and therefore increases the run length between decoking (cleaning), further extending tube life of the process coil.

Consequently, it is an objective of the instant invention to increase process fluid temperature subsequent to pre-heat exchanger processing, and prior to the introduction of such feed to combination tower processing.

It is a further object of the instant invention to serve as a substitution for feed/effluent exchangers by increasing fresh feed exchanger outlet temperatures beyond those temperatures achievable utilizing such exchangers, prior to the introduction of such feed to combination tower processing.

An additional objective of the instant invention is to increase coker charge heater inlet temperatures such that a reduction in firing rates and duty load swings may be realized.

A further object of the instant invention is to provide a means by which process fluid lines and combination tower temperatures may be maintained at an operational level during coke drum swings from one drum to the other drum and during unit cold start ups, thus reducing "start up" time associated with the present art and greatly reducing or eliminating over firing of the coker charge heater.

Other objects and further scope of the applicability of the present invention will become apparent from the detailed description to follow, taken in conjunction with the accompanying drawings wherein like parts are designated by like reference numerals.

DETAILED DESCRIPTION OF THE PREFERRED EMBODIMENT

While the making and using of various embodiments of the present invention are discussed in detail below, it should be appreciated that the present invention provides for inventive concepts capable of being embodied in a variety of specific contexts. The specific embodiments discussed herein are merely illustrative of specific manners in which to make and use the invention and are not to be interpreted as limiting the scope of the instant invention.

The claims and the specification describe the invention presented and the terms that are employed in the claims draw their meaning from the use of such terms in the specification. The same terms employed in the prior art may be broader in meaning than specifically employed herein. Whenever there is a question between the broader definition of such terms used in the prior art and the more specific use of the terms herein, the more specific meaning is intended.

While the invention has been described with a certain degree of particularity, it is clear that many changes may be made in the details of construction and the arrangement of components without departing from the spirit and scope of this disclosure. It is to be understood that the invention is not limited to the embodiments set forth herein for purposes of exemplification, but is to be limited only by the scope of the attached claim or claims, including the full range of equivalency to which each element thereof is entitled.

Figure 1:
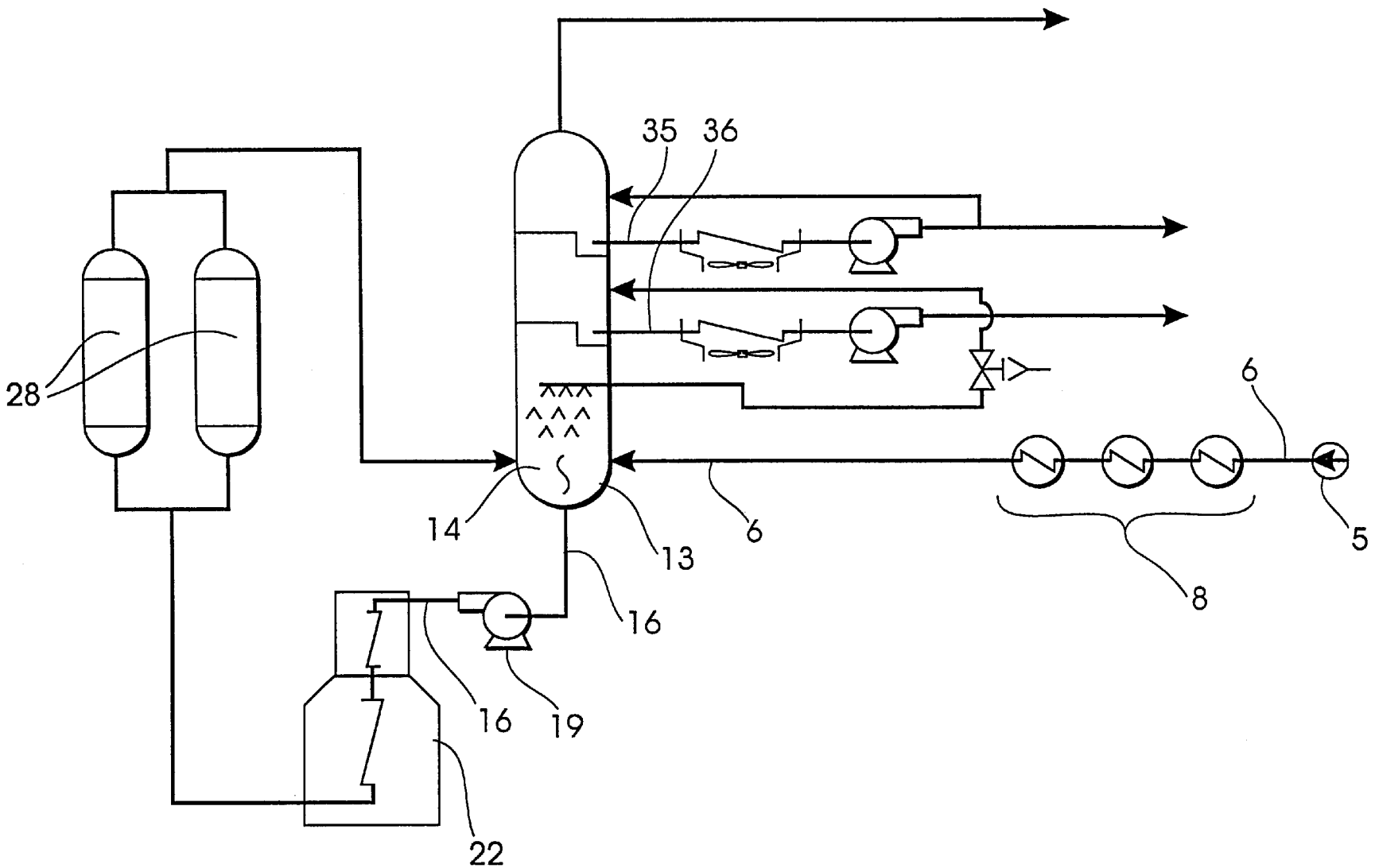
FIG. 1 is an illustration of a typical hydrocarbon refinery configuration as represented in the present art.

FIG. 1 is an illustration of a basic hydrocarbon refinery configuration as found in the present art. In the present art, process fluid (synonymously referred to as "fresh feed", "feed", and "feedstock") first resides in a containment vessel, or tower, 5 and is subsequently introduced to a process fluid pipeline 6 and heated by preheat exchangers 8 before entering into a combination tower 13. The combination tower 13 serves two basic functions. The first is associated with the bottom section of the tower. Hot overhead vapors from the coke drum enter the bottom of the tower and are sprayed with hydrocarbon (commonly heavy gas oil) to remove coke and condense heavier boiling hydrocarbons. Any materials not flashed up the tower at this section are combined with the fresh feed at the bottom of the tower. This combined feed then is pumped by circulation pump 19 to the delayed coker change heater 22. The upper portion of the tower, above the spray nozzles, is used for the distillation process. This commonly consists of overhead vapors 37, light gas oil or distillate 35, and heavy gas oil 36.

After residual bottom materials have been pumped through a post combination tower processing pipeline 16 to a coker charge heater 22 via charge pump 19, burners within the coker 22 heat the residual component material to a temperature necessary to effect coking.

However, inconsistent and varying temperatures of the combination tower bottoms material continuously require changing fuel firing rates to maintain the charge heater 22 outlet temperature. Such variations in firing contribute significantly to reducing the life expectancy of the coker apparatus 22, and increase the number of occasions where the coker charge heater 22 must be "decoked" in order to maintain its operational efficiency.

The present art does not provide for consistency of coker feedstock input temperature. More specifically, the prior art fails to provide for effecting a complimentary coker feedstock input temperature, consistent with the optimal firing rates and temperature to minimize tube side fouling and extend tube life. This deficiency is remedied by the instant invention and is discussed and disclosed in association with FIG. 2.

Figure 2:
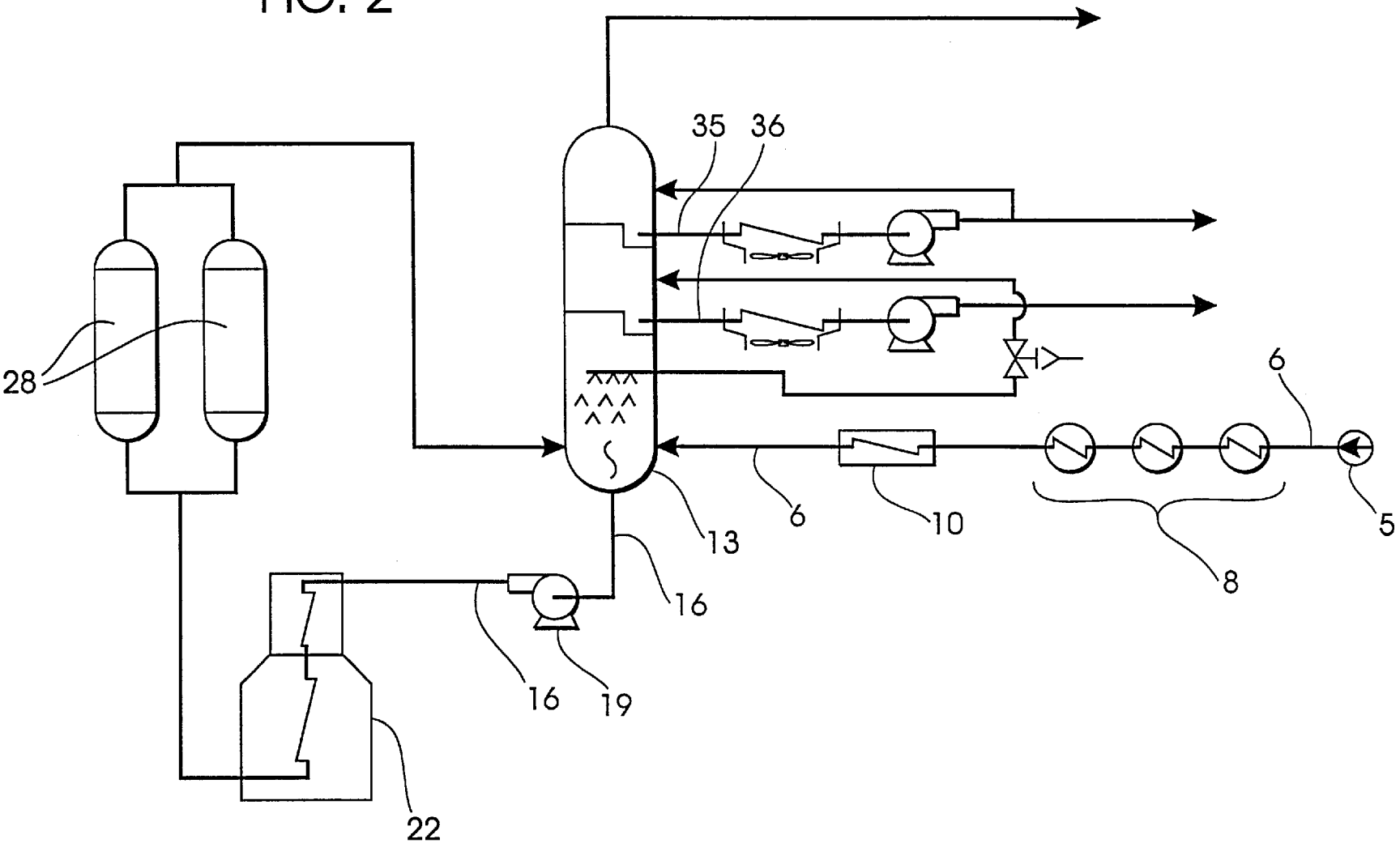
FIG. 2 is an illustration of the invention's preferred embodiment.

FIG. 2 illustrates process fluid being pumped from its originating vessel 5, via a process fluid pipeline 6 through preheat exchangers 8, prior to the introduction of said process fluid into a combination tower 13. However, as can be seen in FIG. 2, the present invention provides for an in-line heater 10 to be inserted between preheat exchangers 8 and the combination tower 13. Having once determined the optimal firing rate and outlet temperature for specific process conditions, a combination tower 13 temperature sensing unit within the combination tower 13 determines whether the residual hydrocarbon components, or "bottoms" temperature is within the optimal firing range of delayed coker charge heater 22.

In the event, the "bottoms" is lower than that required of the coker charge heater 22, a signal is communicated to in-line heater 10 to increase its outlet set point temperature to that required by the coker to effect an optimal firing rate. More specifically, an outlet temperature set point necessary to effect a combination tower 13 bottoms temperature within the optimal firing rate of the coker charge heater 22. Such temperature sensing and communication processes and apparatuses are well represented and known to those skilled in the art. Consequently, in the preferred embodiment of the present invention, the combination tower bottoms temperatures will be maintained in an optimum range to keep the coker charge heater 22 within an optimum firing range. This mode of operation minimizes the amount of overfiring required to effect severe thermal cracking or coking in a coke drum 28 and extends the heater's life by preserving internal components contained therein. FIG. 2 represents the preferred embodiment of the instant invention while FIG. 3 discusses an alternative placement of an in-line heater to effect a constant feedstock temperature capable of effecting optimal coker performance.

Figure 3:
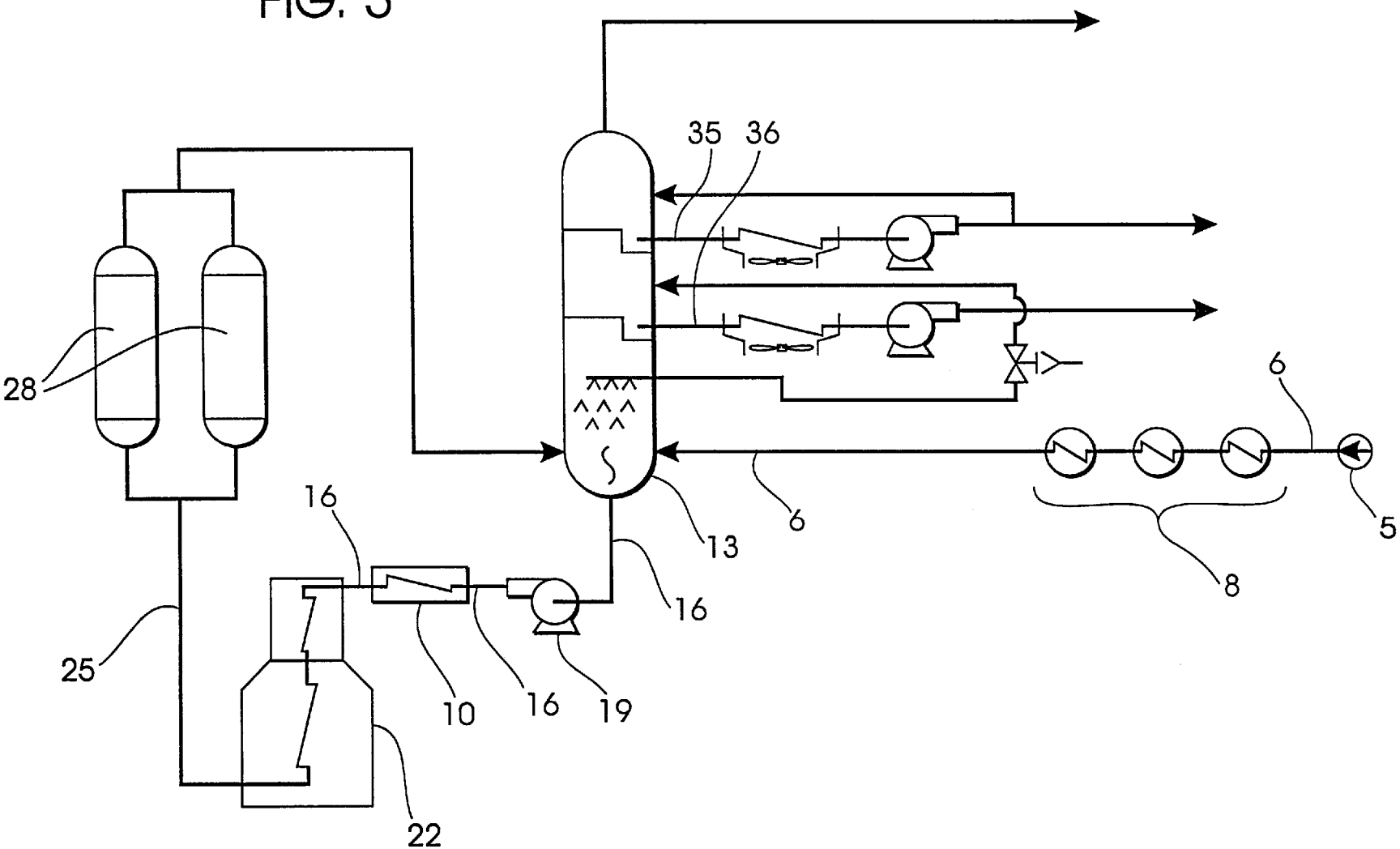
FIG. 3 illustrates an alternative embodiment of the instant invention.
Figure 4:
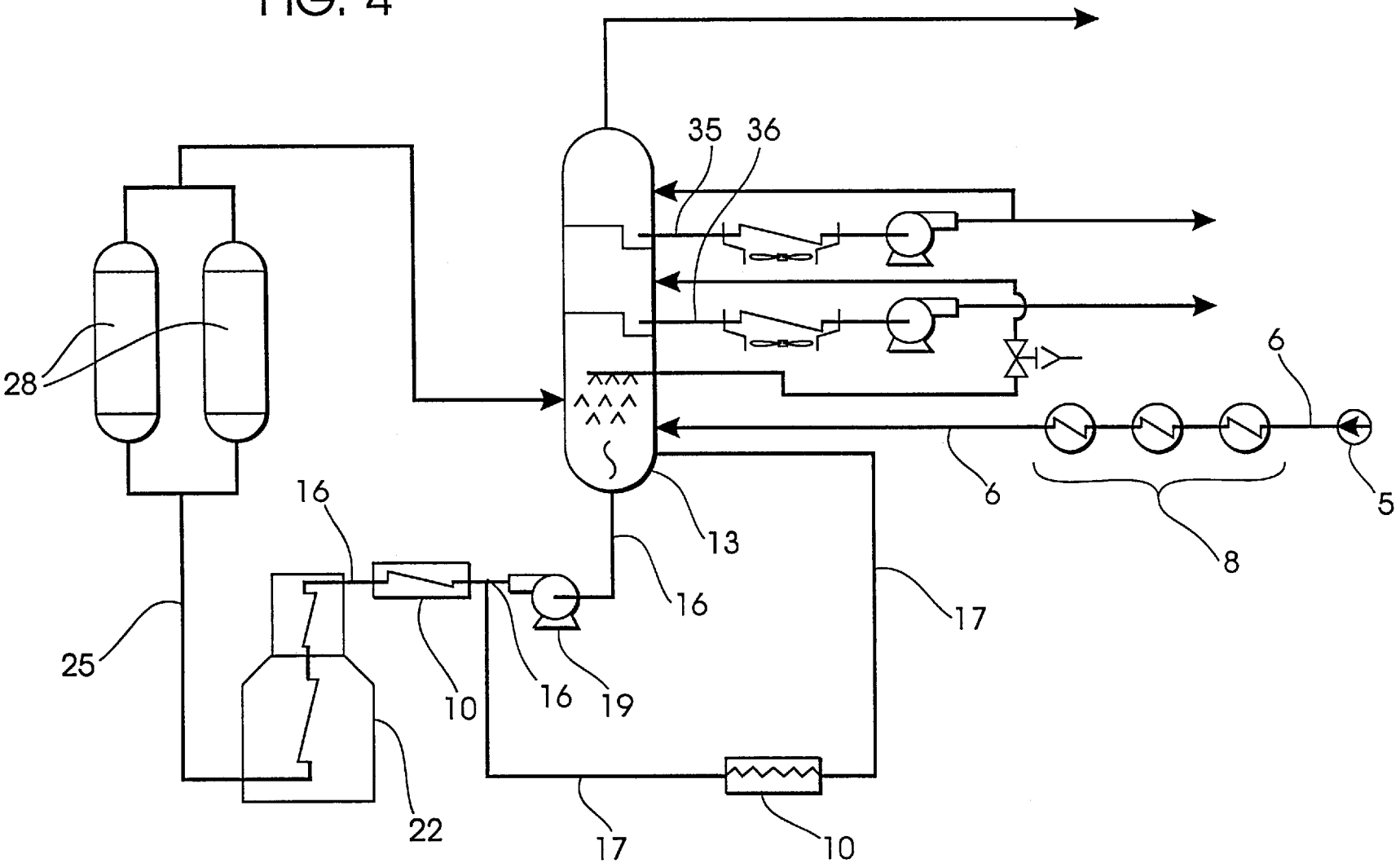
FIG. 4 illustrates an additional alternative embodiment of the instant invention.

As can be seen in FIG. 3, feedstock is pumped from its originating containment vessel 5, introduced to the process fluid pipeline 6 and passed through preheat exchangers 8 before entering the combination tower 13. Upon exiting the combination tower 13, combination tower bottoms are pumped through a post combination tower processing pipeline 16, to an in-line heater 10 by way of a charge pump 19 and then to the coker charge heater 22. In this embodiment the in-line heater 10 is preset to maintain charge heater inlet temperatures at a constant temperature so that the coker charge heater 22 can operate at an optimal and constant firing rate. Turning now to FIG. 4.

Figure 5:
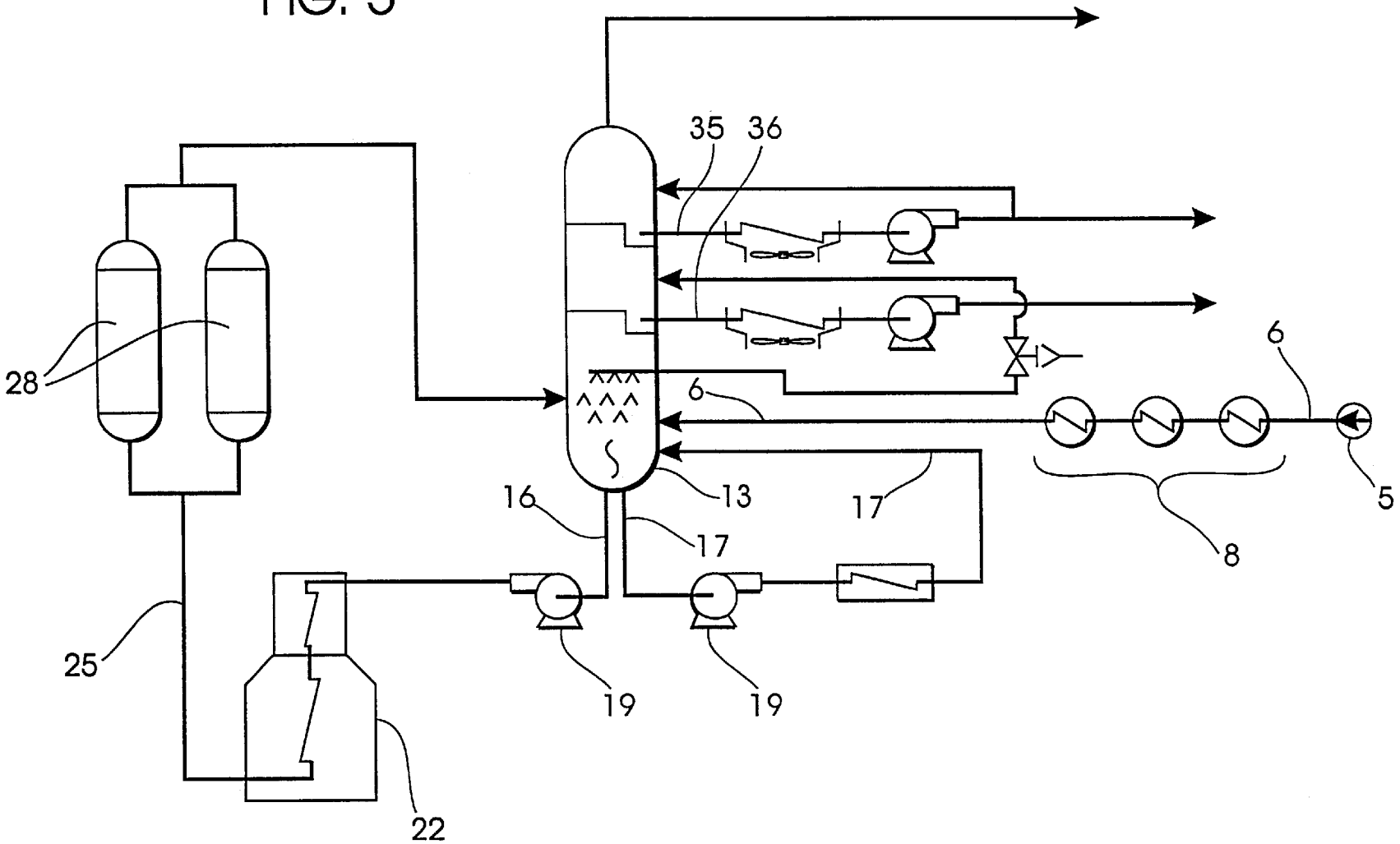
FIG. 5 illustrates a further alternative embodiment of the instant invention.

FIG. 4 illustrates another alternative embodiment of the instant invention. Upon exiting the combination tower 13, combination tower bottoms are pumped through a first combination tower processing pipeline 16 by a charge pump 19 and then to the coker charge heater 22. The embodiment as illustrated in FIG. 4 further illustrates a return of some of the process fluid to the combination tower 13 by way of said process fluid being pumped by the charge pump 19, via said second post combination tower processing pipeline 17 through an in-line heater 10 and into the combination tower 13. Said return via said second post combination tower processing pipeline 17 to act as a stabilizing and conditioning agent with respect to introducing and maintaining consistent tower bottoms temperature within the combination tower 13. FIG. 5 illustrates a further alternative embodiment of the instant invention.

In FIG. 5 upon exiting the combination tower 13, combination tower bottoms are simultaneously pumped through two processing paths. The first processing path by way of a first post combination tower processing pipeline 16 introduces said tower bottoms to a charge pump 19 for subsequent introduction to the coker charge heater 22. At the same time via a second post combination tower processing pipeline 17, tower bottoms leave the combination tower 13 and via a charge pump 19 and are introduced to an in-line heater 10 and then returned to the combination tower 13. Said processing by way of the second post combination tower processing pipeline 17 as illustrated in FIG. 5 is to act as the stabilizing and conditioning agent as discussed in association in FIG. 4.

Figure 6:
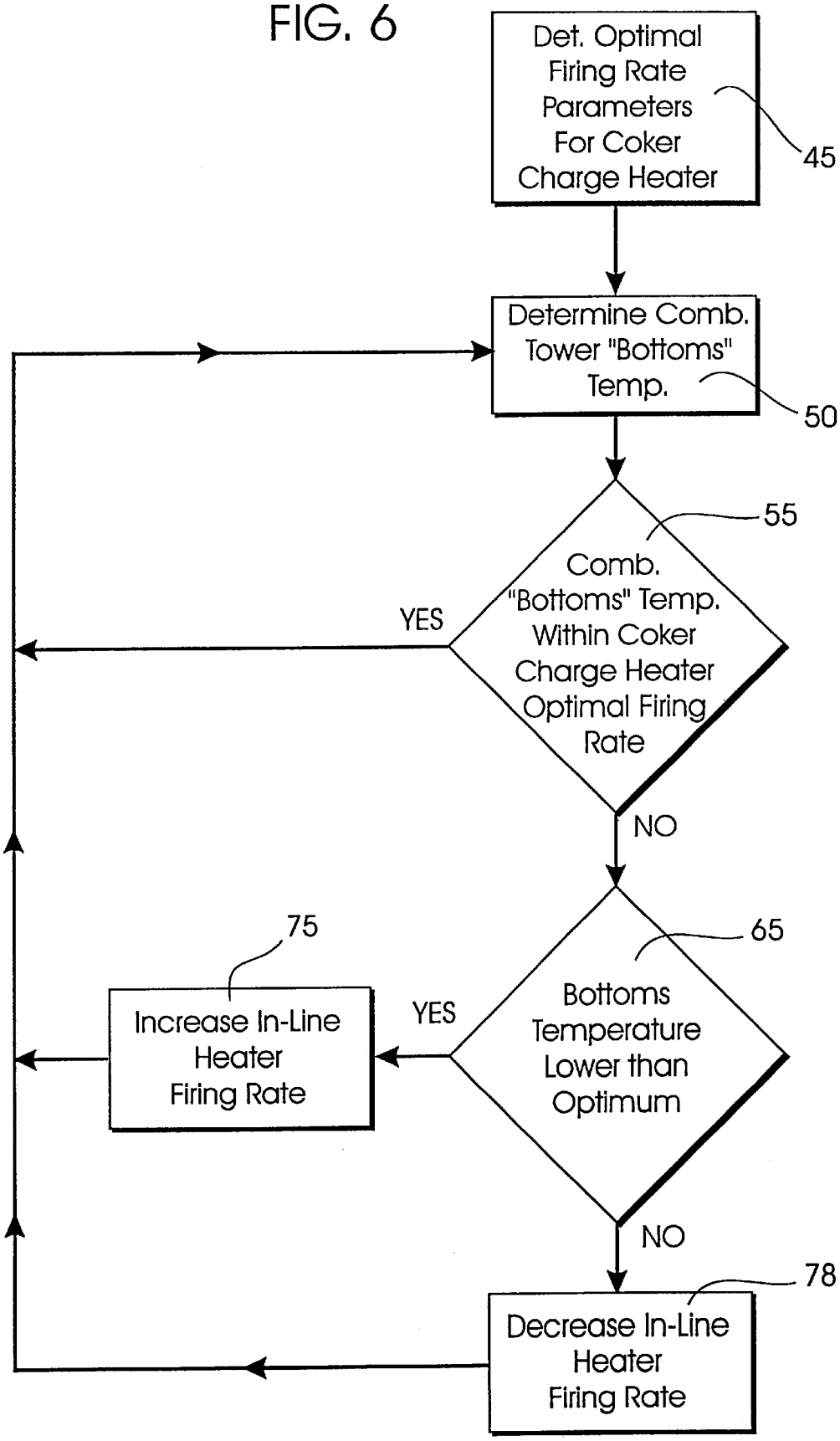
FIG. 6 is a logic flow diagram of the invention's preferred methodology in effectuating and controlling a nearly constant coker charge heater process fluid inlet temperature.

FIG. 6 illustrates a logic flow diagram of the inventions preferred embodiment necessary to effectuate a nearly constant coker charge heater process fluid inlet temperature. Such methodology requires first that the optimal firing rate, or the optimal firing rate range, for a specific coker charge heater and process conditions be identified 45. Once identified, a combination tower sensing unit determines the temperature of the combination tower bottoms 50, and compares the combination tower bottoms temperature to the coker's optimal firing rate temperature to determine if said bottoms temperature is within the coker's optimal firing rate 55. If the combination tower bottoms temperature is within the coker's optimal firing rate, the invention returns to continue to monitor and determine the combination's tower bottoms temperature 50. In the event the combination tower bottoms temperature is less than the coker's optimal firing rate temperature 65, a signal is sent to increase the fuel firing rate of the in-line heater 75. The invention then returns to continue to monitor and determine the combinations tower bottoms temperature 50. In the event the combination towers bottom temperature is higher than the coker's optimal firing rate temperature 78 a signal is sent to decrease the firing rate of the in-line heater. The invention then returns to continue to monitor and determine the combinations tower bottoms temperature 50.

While this invention has been described to illustrative embodiments, this description is not to be construed in a limiting sense. Various modifications and combinations of the illustrative embodiments as well as other embodiments will be apparent to those skilled in the art upon referencing this disclosure. It is therefore intended that this disclosure encompass any such modifications or embodiments.

What is claimed is:

1. A method to regulate the temperature of a coker process fluid to be introduced to a coker charge heater, said process comprising:

determining the optimal firing rate temperature parameters for a coker charge heater;

determining the temperature of bottoms residue within a combination tower;

comparing said residue temperature to said optimal firing rate temperature; and signaling an in-line heater to effectuate a consistent bottoms temperature within said combination tower.

2. The method of claim 1 wherein said signaling of said in-line heater to effectuate a consistent control tower bottoms temperature further comprises heating fresh feed traversing said heater by increasing the fuel firing rate of said in-line heater.

3. The method of claim 1 wherein said signaling of said in-line heater to effectuate a consistent control tower bottoms temperature further comprises setting the outlet set point temperature of an in-line heater to be consistent with said optimal firing rate for a coker charge heater.

4. The method of claim 1 wherein said method further comprises heating such process fluid prior to introducing such fluid to a combination tower.

5. The method of claim 1 wherein said method further comprises heating said process fluid subsequent to introducing said fluid to a combination tower and prior to introducing such fluid to said coker charge heater.

6. The method of claim 1 wherein said method further comprises pumping said fluid through an in-line heater.

7. The method of claim 6 wherein said pumping is facilitated by a charge pump.

* * * * *